US006814156B2

(12) United States Patent
Dieterle et al.

(10) Patent No.: US 6,814,156 B2
(45) Date of Patent: Nov. 9, 2004

(54) HAND GUIDED ELECTRICAL TOOL WITH AN AUXILIARY HANDLE

(75) Inventors: Andreas Dieterle, Wessling (DE); Stephan Niehaus, Berglen (DE); Ulrich Rössler, Leutenbach (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/071,693

(22) Filed: Feb. 8, 2002

(65) Prior Publication Data

US 2002/0125022 A1 Sep. 12, 2002

(30) Foreign Application Priority Data

Feb. 9, 2001 (DE) ..... 101 06 050

(51) Int. Cl.[7] ..... B27C 3/08

(52) U.S. Cl. ..... 173/170; 173/217; 16/110.1; 16/422; 16/426

(58) Field of Search ..... 173/170, 217, 173/162.1, 162.2; 81/489; 16/110.1, 422, 426

(56) References Cited

U.S. PATENT DOCUMENTS 4,785,540 A * 11/1988 Arvidsson ..... 173/170
4,819,742 A * 4/1989 Driggers ..... 173/162.2
4,820,090 A * 4/1989 Chen ..... 408/241 R
4,825,548 A * 5/1989 Driggers ..... 30/276
5,025,870 A * 6/1991 Gantner ..... 173/162.2
5,669,101 A * 9/1997 Aiyama et al. ..... 16/426
5,687,483 A * 11/1997 Neubert et al. ..... 30/312
5,996,708 A * 12/1999 Gerold ..... 173/162.1
6,112,831 A * 9/2000 Gustafsson ..... 173/170
6,241,594 B1 * 6/2001 Lepold ..... 451/359

* cited by examiner

*Primary Examiner*—John Sipos
*Assistant Examiner*—Michelle Lopez
(74) *Attorney, Agent, or Firm*—Sidley Austin Brown & Wood, LLP

(57) ABSTRACT

A hand guided electrical tool is formed of a housing (1) and a guide part (2) for mounting a drive shaft (3) in addition to a handle (6*a*) and further an auxiliary handle (5) that can be secured by a locking ring (4) for precise guidance. To assure simple adjustment by the user, the locking ring (4) runs in the axial direction of the drive shaft (3). Furthermore, the auxiliary handle (5) is designed spade-shaped and pivotable around an axis of rotation parallel to the drive shaft (3) and can be secured or locked in different positions. The inside diameter of the locking ring (4) can be changed by means of an actuator element (8).

5 Claims, 9 Drawing Sheets

HAND GUIDED ELECTRICAL TOOL WITH AN AUXILIARY HANDLE

FIELD OF THE INVENTION

The invention relates to an hand guided electrical tool, formed of a housing with a guide part for mounting a drive shaft and an auxiliary handle fixed in position using a locking ring, whereby the locking ring is guided in the axial direction coaxial of a drive shaft and encircles the guide part.

BACKGROUND OF THE INVENTION

Electrical tools of the type described above have an auxiliary hand grip on the housing to provide more precise and safer guidance of the electrical tool by the user. In order to assure optimum guidance, such an auxiliary handle is arranged in the region of the drive shaft.

Such an electrical tool is, for example, disclosed in EP-A2-249037. Such electrical tool uses a rod-shaped auxiliary handle that can be securely clamped by a locking ring onto the guide part of the electrical tool housing. The guide part has an annular groove into which a rib, arranged on the locking ring, can be engaged for the axial guidance of the auxiliary handle. To provide assurance against rotation the guide part is formed with longitudinal notches distributed over its periphery into which an annular detent arranged on the locking ring can be brought. The advantage of this known electrical tool is that the auxiliary handle is secured in the set position both axially and radially against displacement relative to the guide part. The disadvantage is that the auxiliary handle in the unlocking condition is not guided in any direction and any further precise adjustment by the user is thus made more difficult. Furthermore, the adjustment of the auxiliary handle between the set condition and the unlocked condition is done using a screw connection, which does not allow securing of the auxiliary handle without the use of tools.

A further similar electrical tool is disclosed in EP-A2-132593. Such electrical tool is provided with an auxiliary handle having a locking ring and a strap retainer that partially encloses a guide part. Using a rotary motion the strap retainer is drawn tight by a screw connection and as a result is secured in a friction locked manner by the rod-shaped auxiliary handle to the guide part. The advantage is that the securing of the auxiliary handle is possible without the use of tools. However, the rotation is a time-consuming and awkward process for the user and impacts negatively on the user-friendliness of the known electrical tool.

SUMMARY OF THE INVENTION

The primary object of the present invention is the creation of an hand guided electrical tool with an auxiliary handle that can be easily adjusted without the use of tools and allows precise guidance.

According to the invention, the object is achieved in that the auxiliary handle is formed spade-shaped and the locking ring can be pivoted and secured in different positions around an axis of rotation parallel to the drive shaft.

The spade shape design makes it possible for the user to guide the electrical tool with precision and ease. Spade-shaped signifies here a triangular design of the cross-section of the auxiliary handle in a plane running transversely of the axis of the drive shaft, whereby a vertex of the handle serves as the anchoring point. Since the auxiliary handle pivots only around a rotational axis that is parallel to the axis of the drive shaft, the user can easily adjust the auxiliary handle, since with the rotary movement there is only one direction of freedom for the movement, in particular for adjustment of the auxiliary handle.

Advantageously, the overall cross-section of the locking ring providing for the passage of the guide part can be variably set using an actuation element in order to secure an optimum adjustment. When making the adjustment, the reduction of the overall dimension of the locking ring can effect either a friction locked or a form-locked connection with the guide part of the housing. Preferably the actuation element is arranged in the region of the locking ring in order to allow the highest possible stability of the handle. The actuation element should, however, be accessible by the user even from a holding position of the handle. This is achieved by appropriate dimensioning of the auxiliary handle. Furthermore, the use of an actuation element allows the user to easily check whether the auxiliary handle is or is not properly secured on the guide part.

In a preferred embodiment, the actuator element is pivotally mounted transverse to the axis of the drive shaft in order to optimize adjustment of the handle. In particular, if the user actuates the actuator element with the same hand and without releasing the auxiliary handle, such an arrangement of the actuation element is particularly advantageous.

Preferably, the actuation element is mounted pivotally along the drive shaft so that the user can exert sufficient force for movement of the actuation element without having to release the auxiliary handle. In a preferred embodiment, the auxiliary handle is dimensioned in such a way that the hand placed on the auxiliary handle can move the actuation element against the free end of the auxiliary handle and using the thumb can return it to the starting position. In another preferred embodiment, the actuation element is designed as a two-stage adjustment element. In this way the setting between the secured position and an adjustment position is facilitated for the user.

The actuation element advantageously has a contact element that can be brought into contact with the guide part by pivoting the actuation element and thereby securing the latter. In this way, on the one hand, economical manufacture of the handle in effected and, on the other hand, a high degree of reliability is assured, since only few individual parts are employed.

The locking ring is advantageously comprised of several parts, whereby a locking part with toothing can be brought in a form locked manner with complementary toothing formed on the guide part. Securing with minimum operation force is assured by the multi-part design of the locking ring. Furthermore, this design of the locking ring allows a larger area to be provided with toothing, since it is arranged radially to the guide part.

Preferably, the locking part is set against a spring biased force which results in a reduction of the force that the user needs to apply for release.

The actuation element is advantageously mounted eccentrically on the auxiliary handle in order, for example, to effect simple securement of the auxiliary handle on the guide part. The eccentric mounting on the auxiliary handle results in an adjustment option for the auxiliary handle on the guide part that is economical to produce. By using a lever means, for example, the force required by the user for setting can be kept to a minimum; this has a positive effect on the handling of the auxiliary handle.

The locking ring is advantageously characterized by at least one coaxial clamping ring arranged rotatably relative to the locking ring, wherein the clamping ring has at least one clamping tongue that can be brought into contact with the guide part. The use of a clamping tongue assures economic production of the auxiliary handle. Furthermore, the coaxial arrangement of the two rings results in their optimum guiding. Depending on the stress on the connection a plurality of clamping tongues can be used.

Preferably a retaining band is arranged between the locking ring and the guide part, which can be tightened by a clamping bolt that is rotatable eccentrically, parallel to the axis of the guide part. By the combination of an eccentrically rotatable bolt and a retainer strap around the guide part, the auxiliary handle is easily operated. The retainer strap can be set by application of minimal force using the clamping bolt.

In a further preferred embodiment the actuation element is characterized by an eccentric bolt that is tangential to the guide part and passes through the locking ring. The eccentric bolt is mounted rotatably in the guide part. In addition, the user can set the locking ring by mere rotation of the eccentric bolt using the actuation element. On turning, the eccentricity results in a reduction of the dimension of the inner diameter of the locking ring. In this manner the locking ring is set.

Preferably, the locking ring has toothing and the guide part complementary toothing that can be brought together in form-fitting engagement to assure a secure connection. The toothing can be executed, for example, in a saw toothed form over the periphery by ridges or similar means.

BRIEF DESCRIPTION OF THE DRAWING

The invention is more completely explained using an exemplary embodiment read together with.

DETAILED DESCRIPTION OF THE INVENTION

Figure 1:
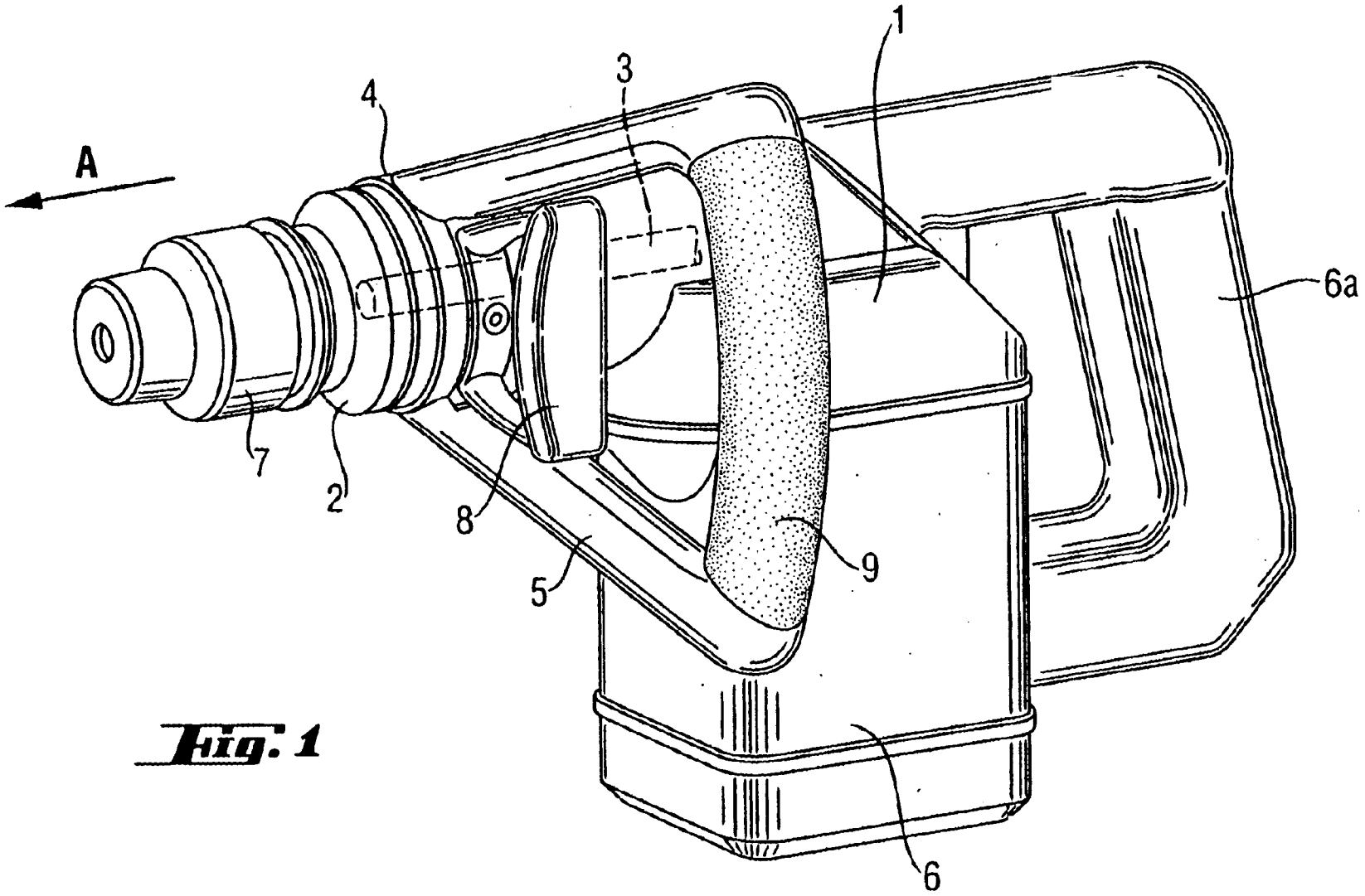
FIG. 1 is a perspective representation of a hand guided electrical tool with an auxiliary handle according to the invention.
Figure 3:
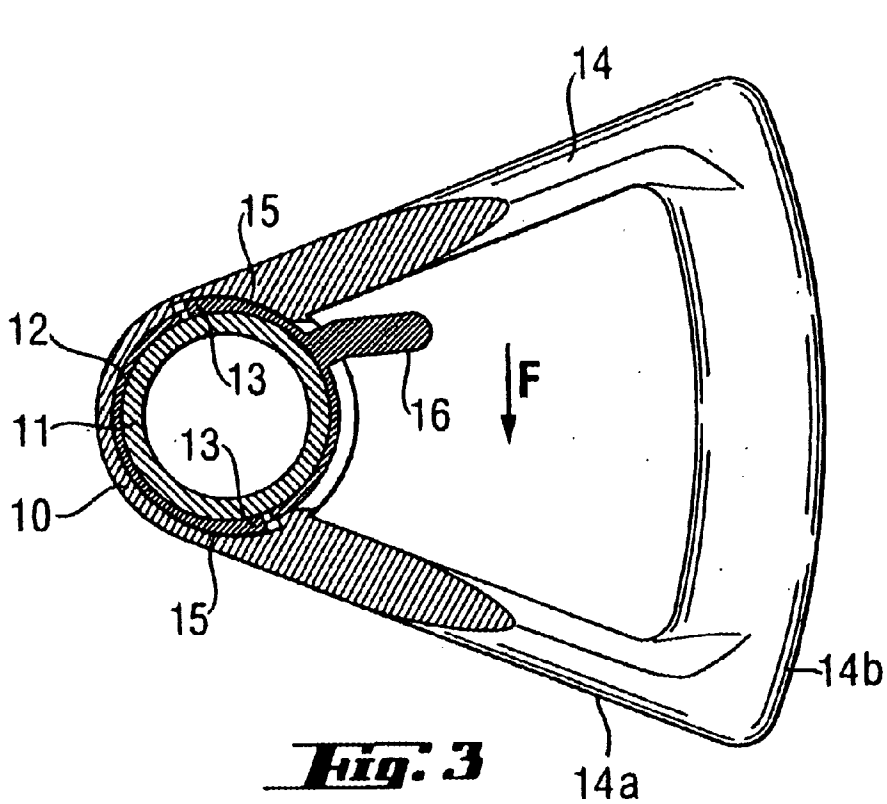
FIG. 3 is a cross-section through the locking ring shown in FIG. 2 in the locked position.
Figure 2:
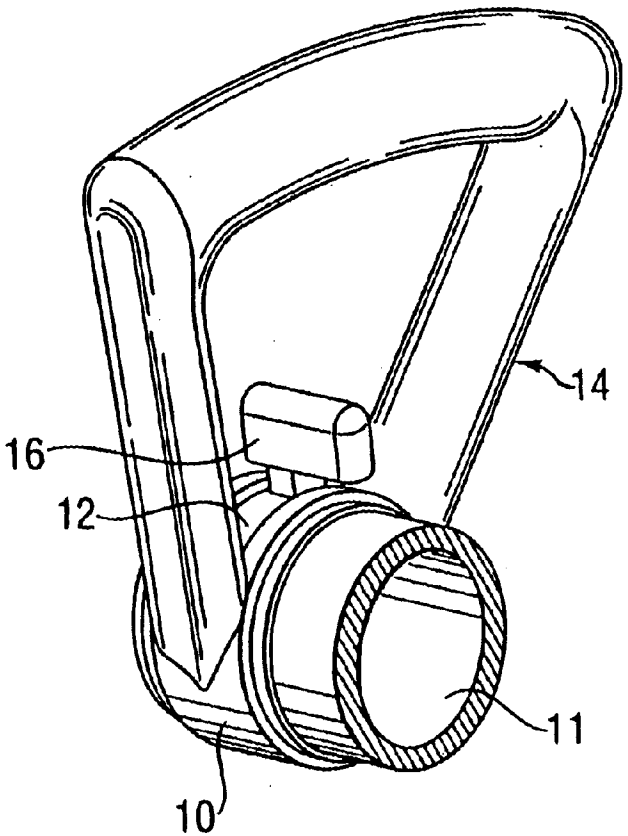
FIG. 2 is a perspective representation of a first embodiment of a locking ring in the unlocked position.
Figure 5:
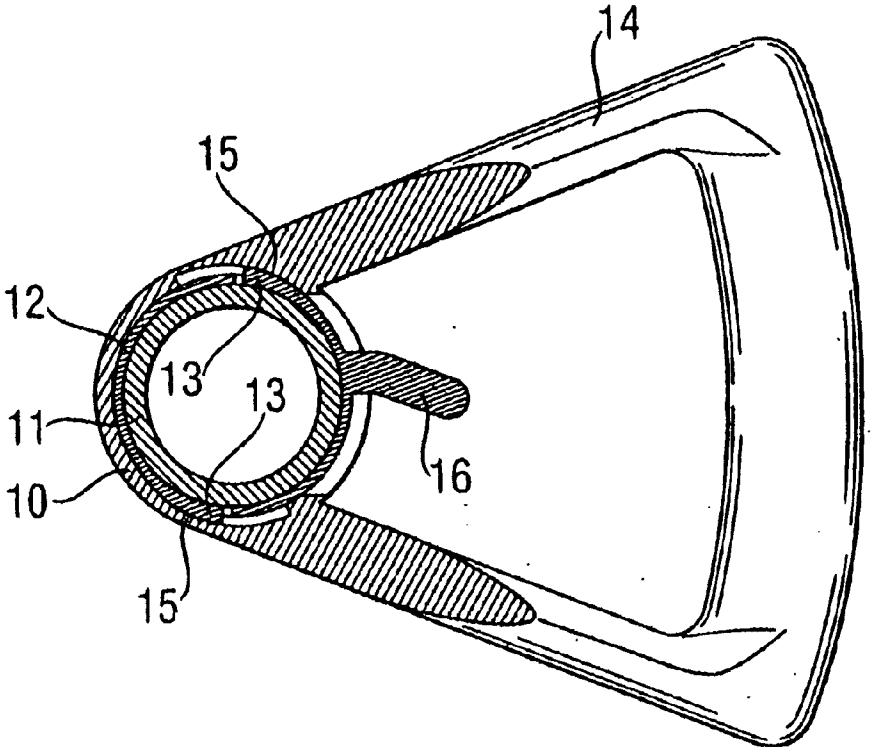
FIG. 5 is a cross-sectional view through the locking ring in FIG. 2 in the unlocked position.
Figure 4:
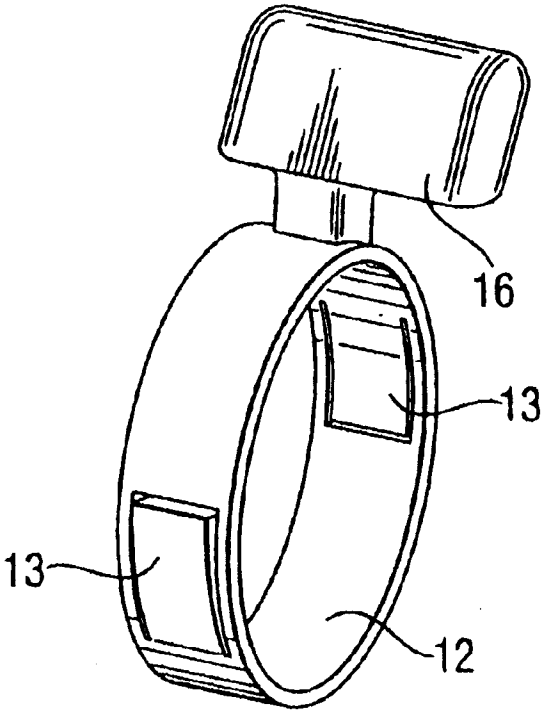
FIG. 4 is a perspective representation of a clamping ring of the locking ring displayed in FIG. 2.
Figure 7:
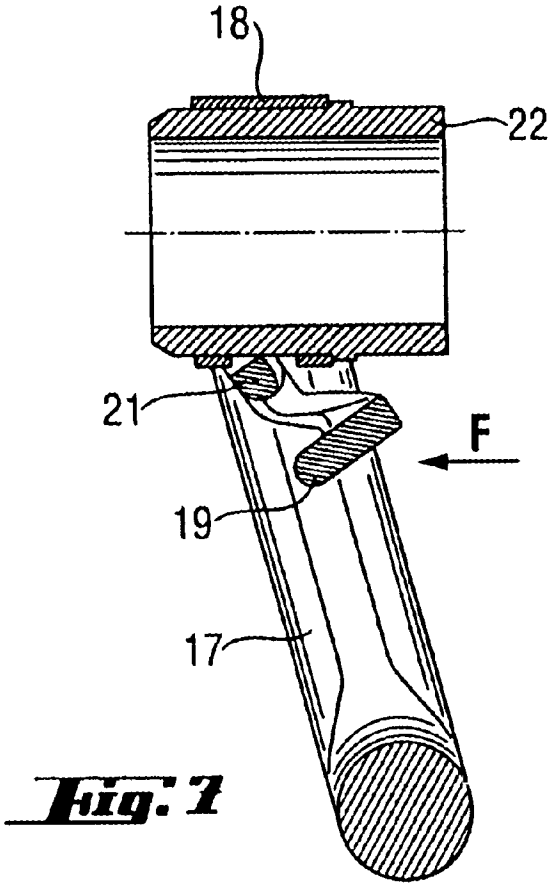
FIG. 7 is a cross-section of the locking ring represented in FIG. 6 in the unlocked position.
Figure 6:
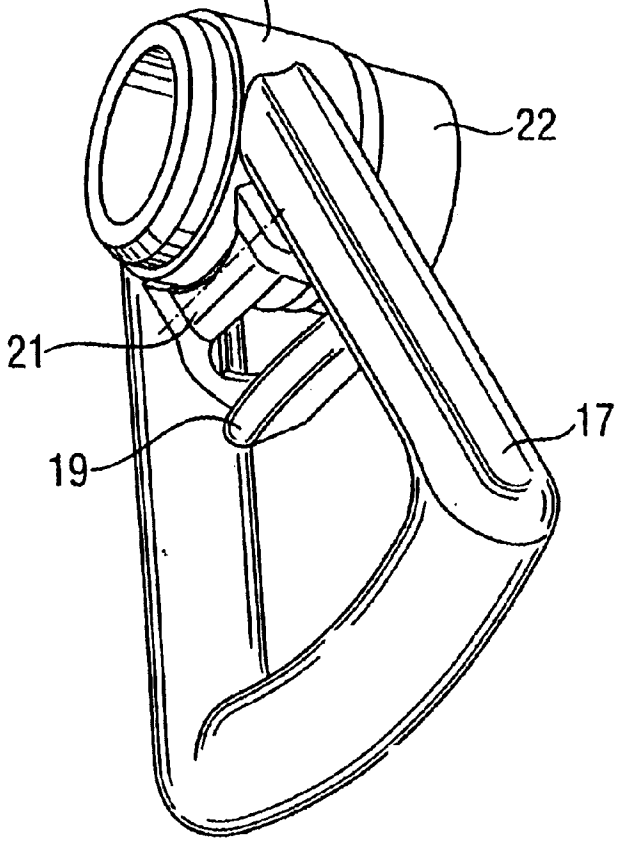
FIG. 6 is a perspective view of a second embodiment of a locking ring in the unlocked position.
Figure 9:
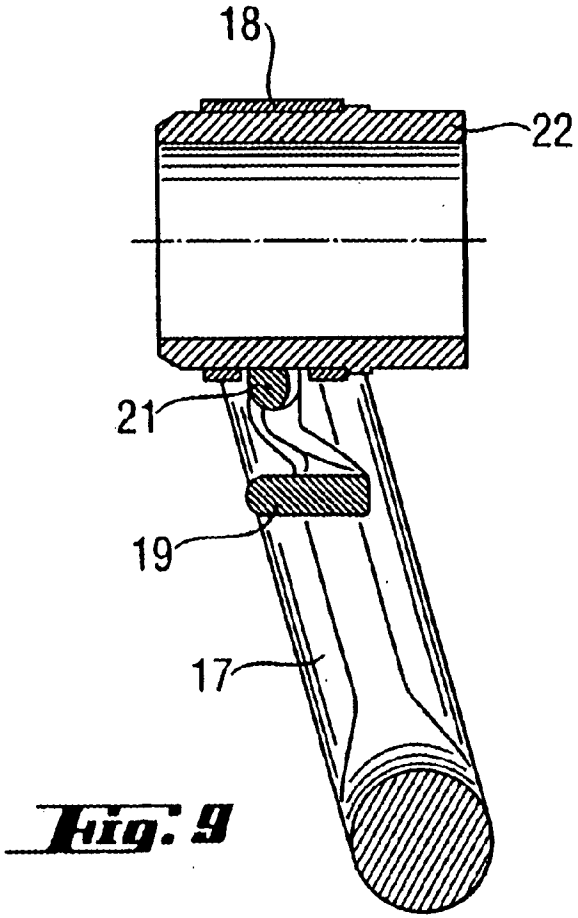
FIG. 9 is a cross-sectional view through the locking ring set forth in FIG. 6 in the set position.
Figure 8:
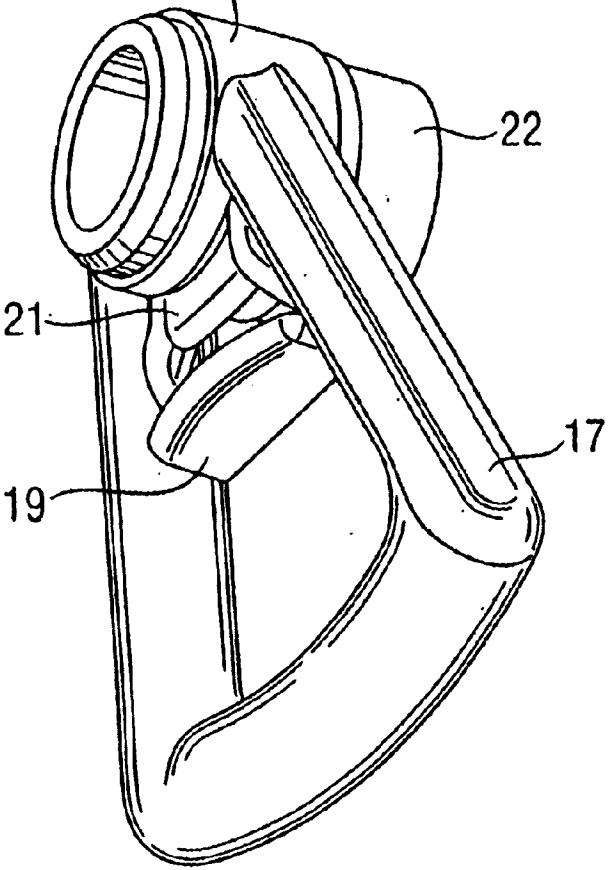
FIG. 8 is a perspective representation of the clamping ring of the locking ring shown in FIG. 6 in the set or locked position.
Figure 11:
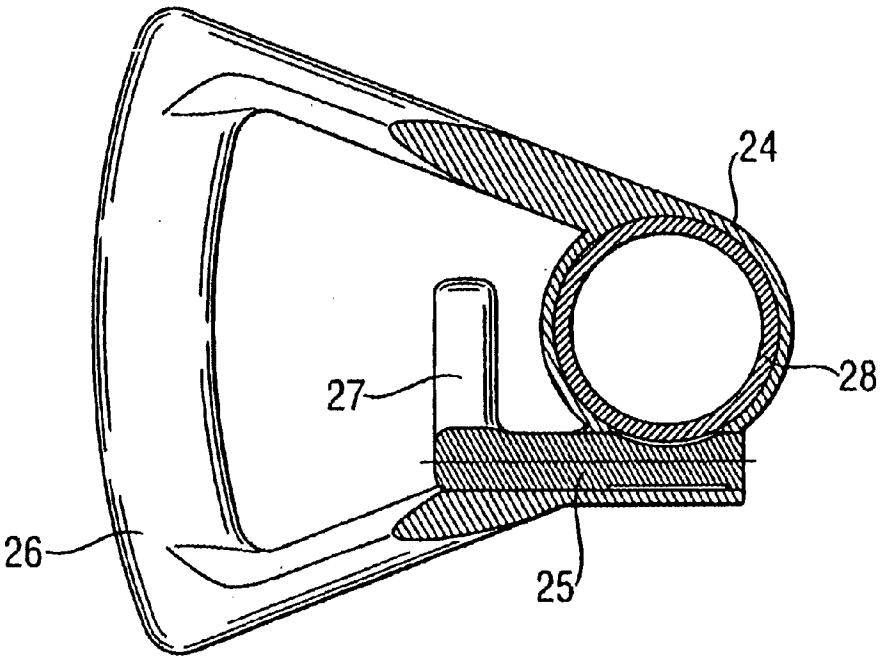
FIG. 11 is a partial cross-sectional view through the locking ring in FIG. 10 in the unlocked position.
Figure 10:
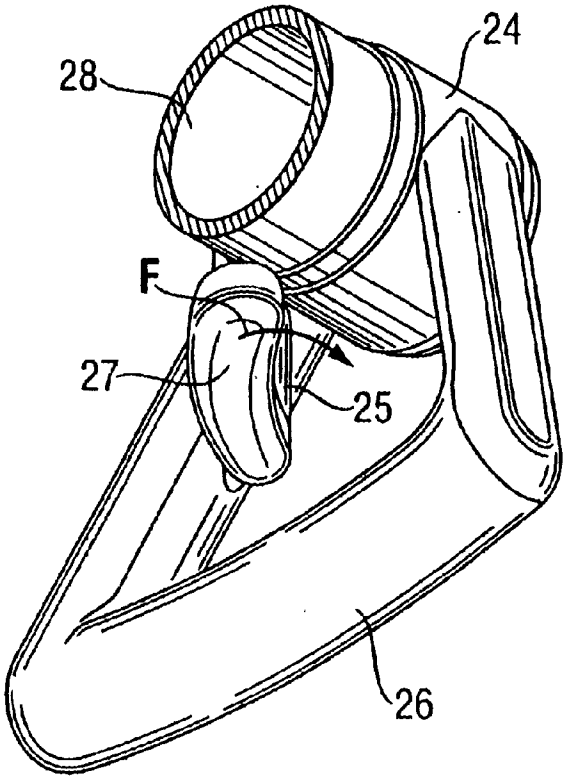
FIG. 10 is a perspective showing of a third embodiment of a locking ring in the unlocked position.

In FIG. 1 a hand guided electrical tool embodying the invention, in particular a drill, is represented comprised of a housing 1 and a guide part 2 for holding a drive shaft 3. A spade-shaped auxiliary handle generally designated by 5 is secured on the electrical tool by means of a sleeve-like locking ring 4 enclosing the guide part 2, whereby the locking ring 4 extends in the axial direction of the drive shaft 3. The locking ring 4 is pivotable around an axis of rotation parallel to the drive shaft and can be secured in different positions. The locking ring 4 is arranged at one corner of the spade-shaped auxiliary handle 5 formed radially outwardly by two radially outwardly emerging arms 14*a* terminating at a cross arm 14*b*.

The locking ring 4 is received in an annular recess in the guide part 2 in order to prevent displacement axially to the drive shaft 3 of the guide part 2.

The housing 1 includes a grip or main handle 6*a* and a motor housing 6. In the working direction A a tool chuck 7 is arranged attached to the indicated drive shaft 3 and cooperates with the drive shaft 3.

The locking ring 4 is characterized by a block-shaped actuation element 8 that is used for setting the locking ring 4. The auxiliary handle 5 is characterized at least in part by a coating 9 to prevent undesired slippage of the user's hand. The coating 9 can, for example, be of rubber or similar material.

In the following FIGS. 2 to 15 five exemplary embodiments of auxiliary handles are represented.

In FIGS. 2 to 5 a first embodiment of a locking ring 10 with an actuation element 16 is shown. The locking ring 10 has a coaxially arranged clamping ring 12 that is rotatable relative to the locking ring. The clamping ring 12 includes at least one clamping tongue 13 that can be brought into contact with a guide part 11 as is represented in particular in FIG. 4. The clamping tongue 13, in particular the clamping ring 12, is secured by rotation relative to the auxiliary handle 14 into a locked position at the guide part 11 as is displayed in particular in FIG. 5. In its radial projection region the clamping tongue 13 and the locking element 10 cooperate by way of the clamping pads 15. As a result of rotation in the setting direction F, the clamping pads 15 urge the two diametrically arranged clamping tongues 13 against the guide part 11 and thus secure the auxiliary handle 14 in a friction locked manner to the guide part 11. Release of the connection is obtained by rotation opposite to the setting direction F, as shown particularly in FIG. 3. Particularly in FIG. 4, the clamping ring 12 is represented together with the actuation element 16.

The auxiliary handle 5, 14 is triangularly shaped in a plane extending transversely of the axis of the drive shaft 3 with its two arms 14*a* extending radially outwardly from the locking ring 10. The arms 14*a* are in a radially outward diverging relationship and terminate at the opposite ends of the cross arm 14*b*.

In FIGS. 6 to 9 an auxiliary handle 17 is represented together with a locking ring 18. An actuation element 19 is mounted between the two diverging arms of the auxiliary handle 17 adjacent to the locking ring. The actuating element 19 is formed by a contact element 21 that can be brought into a locked position in contact with the outer surface of the guide part 22 by pivoting the actuation element 19 and is thus secured in a friction locked manner, as is represented in particular in FIGS. 6 and 7. By swinging the actuation element 19 opposite the securing direction F the auxiliary handle 17 is again pivotable parallel to the axis of the drive shaft (not shown).

Figure 13:
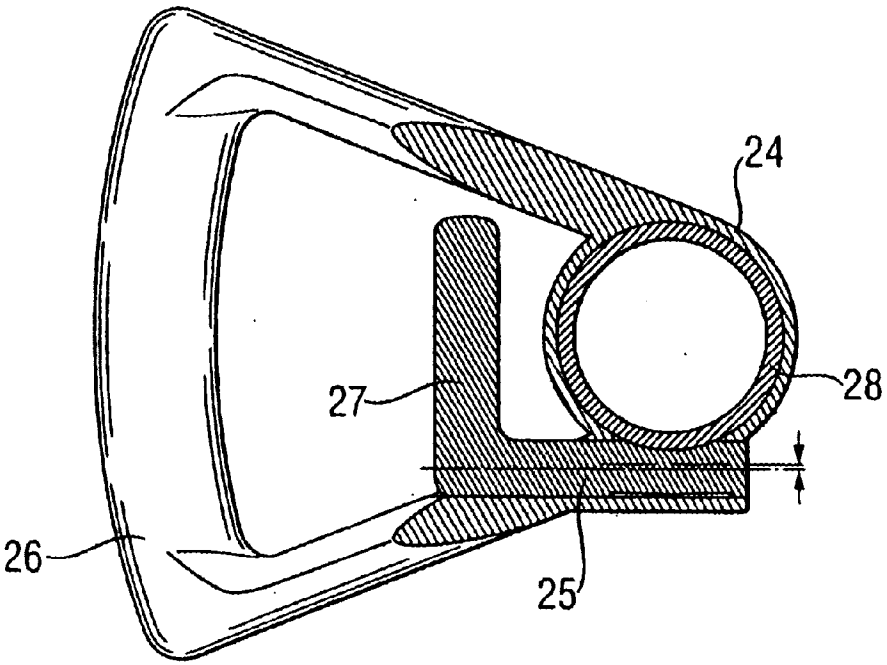
FIG. 13 is a cross-sectional view of the locking ring in FIG. 10 in the set or locked position.
Figure 12:
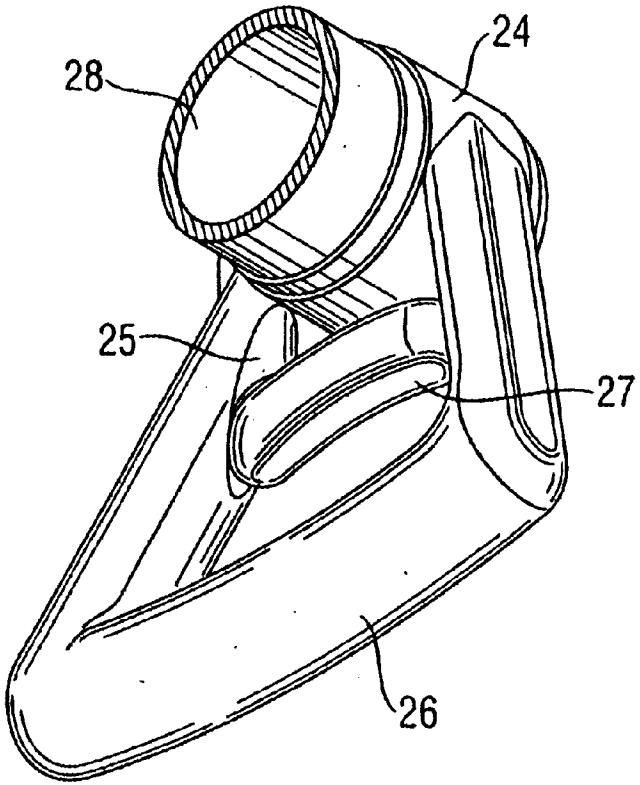
FIG. 12 is a perspective representation of a clamping ring of the locking ring shown in FIG. 10 in the set or locked position.

In FIGS. 10 to 13 a third embodiment is displayed with an auxiliary handle 26 that can be secured by a locking ring 24 at a guide part 28. The locking ring 24 is penetrated by an eccentrically rotatable eccentric bolt 25 mounted in the locking ring 24 in such a fashion that the locking ring, by rotation, can be brought into contact with the outer surface of the guide part 28 and so into the locked position F. In FIGS. 12 and 13 the locking ring 24, secured by the eccentric bolt 25, is represented. Therein the outer surface of the eccentric bolt 25 in the region of contact with the guide region 25 in the cross-section of the axis of the latter is designed circularly and complementarily to the outer surface of the guide part 28, however, with an eccentricity to the longitudinal axis of the eccentric bolt. An actuation element 27 is arranged at the free end of the eccentric bolt 25 normal to its axis.

Figure 14:
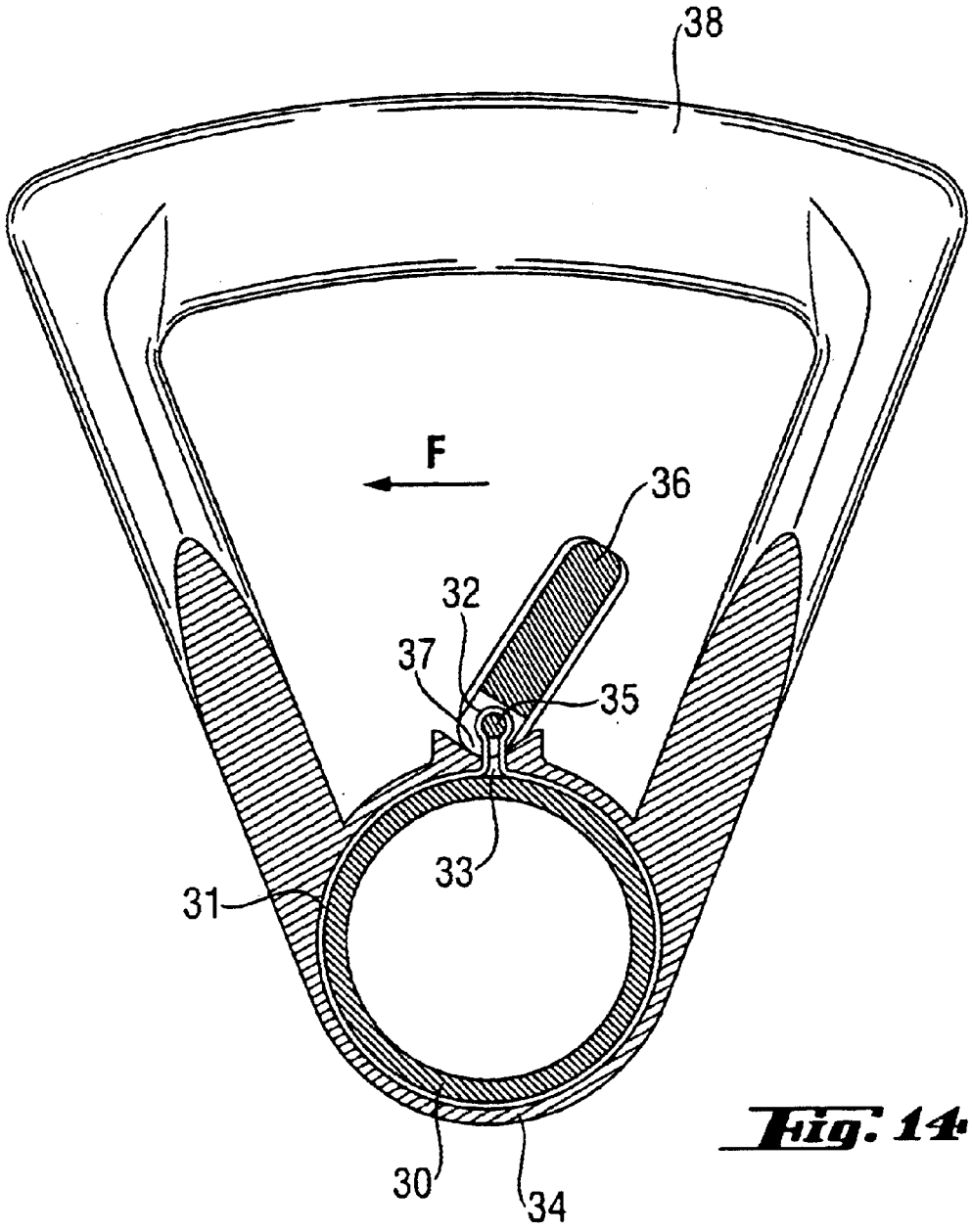
FIG. 14 is a cross-sectional view of a fourth embodiment of a locking ring in the set position.

A fourth embodiment is represented in FIG. 14. A guide part 30 is surrounded on its circumference by a retention band 31. A loop 32 of the retention band 31 is passed through a slit 33 in a locking ring 34 surrounding the guide part 30 and the retention band 31. A clamping bolt 35 running parallel to the axis of the guide part 30 passes through the loop 32 of the retention band 31. The clamping bolt 35 is arranged at one end 37 of an actuation element 36 and perpendicular to it. The end 37 has a circular cross-section running eccentrically to the clamping bolt 35 and is rotationally mounted in a complementary recess in the locking ring 34. By virtue of the eccentric arrangement of the clamping bolt 35, the retainer band 31 encircling the guide part 30 is tightened by the pivoting of the actuation element 36 in a setting direction F and therewith secures the guide part 30 relative to the locking ring 34 which is fixed to an auxiliary handle 38. By pivoting in a direction opposite to that of the setting direction F the retainer band 31 is again loosened and the guide part 30 thus released again.

Figure 15:
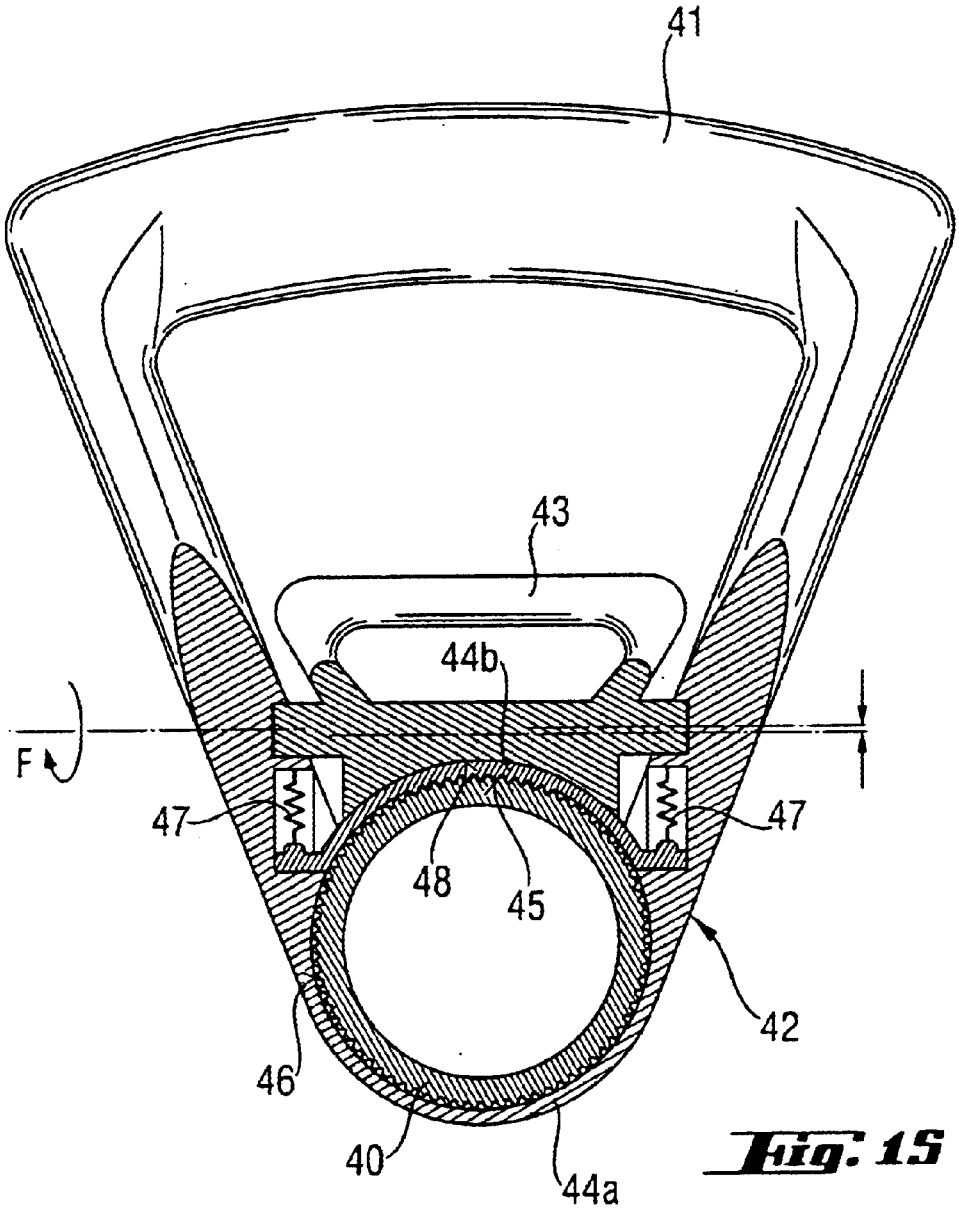
FIG. 15 is a cross-sectional view of a fifth embodiment of a locking ring in the unlocked position.

A fifth exemplary embodiment is represented in FIG. 15 that has an auxiliary handle 41 that can be secured on a guide part 40. The auxiliary handle 41 can be secured by means of a locking ring 42 by positioning an actuation element 43 on the guide part 40. The sleeve-shaped locking ring 42 is characterized by two plates; that is, a first plate 44*a* which is fixed to the auxiliary handle 41 and a second plate 44*b* that is moveably mounted radial to the guide part 40. The second plate 44*b* of the locking ring 44 has a toothing 45 which can be brought into engagement with a counter-toothing 46 arranged on the guide part 40 and is drawn radially therefrom by a spring element 47 radial to the guide part 40.

The actuation element 43 is, as in the second embodiment, mounted eccentrically rotatable between two arms of the auxiliary handle 41 and by means of a contact surface 48 brought into contact with the outer surface of the second plate 44*b*. The contact surface 48 is designed rotationally symmetrical to the rotational axis of the actuation element 43.

On turning of the actuation element 43 in the setting direction F, the second plate 44*b* is brought by the toothing 45 into engagement with the guide part 40, in particular by the counter-toothing, against the bias of the spring element 47.

What is claimed is:

1. A hand guided electrical tool comprising a housing (1) with a guide part (2, 11, 22, 28, 30, 40) for mounting an axially extending drive shaft (3) and an auxiliary handle (5, 14, 17, 26, 38, 41) projecting radially outwardly from said housing (1), a locking ring (4, 10, 18, 24, 34, 42) associated with said auxiliary handle and arranged to set said auxiliary handle on said guide part, said auxiliary handle is guided in the axial direction of said drive shaft and encircles said guide part, said auxiliary handle is spade-shaped and said locking ring can be pivotally displaced around a rotational axis related to said drive shaft and includes an actuator element (8, 16, 19, 27, 36, 43) for securing said locking ring in a plurality of different positions, said auxiliary handle has two arms 14*a* extending radially outwardly from said locking ring in diverging relationship and terminating at a cross arm 14*b* joining the outer ends of the arms 14*a*, and said actuator element located within the plane of said auxiliary handle space between said arms 14*a* and radially inwardly of said cross arm 14*b*.

2. A hand guided electrical tool, as set forth in claim 1, wherein said locking ring (4, 10, 18, 24, 34, 42) has an inside diameter whereby said locking ring is pivotally displaceable around said guide part (2, 11, 22, 28, 30, 40) and said actuator element (8, 16, 19, 27, 36, 43) is arranged for variably displacing said locking ring and for securing said locking ring.

3. A hand guided electrical tool, as set forth in claim 2, wherein said actuator element (8, 19, 43) is mounted for pivotal movement in the direction of the drive shaft (3) axis.

4. A hand guided electrical tool, as set forth in claim 3, wherein said locking ring (42) is formed of two plates (44*a*, 44*b*) comprising a first plate (44*a*) fixed to said auxiliary handle (41) and a second plate (44*b*), said first plate has counter toothing (46) and said second plate (44*b*) has toothing (45) arranged to engage in a form fitting manner with said counter toothing (46).

5. A hand guided electrical tool, as set forth in claim 4, wherein said second plate (44*b*) can be fixed against a spring element (47) forming a spring force.

* * * * *